US006007594A

United States Patent [19]

Kaczor

[11] Patent Number: 6,007,594

[45] Date of Patent: Dec. 28, 1999

[54] MULTIPLE USE DISPOSABLE VACUUM CLEANER BAG

[76] Inventor: Daniel A. Kaczor, 2854 Moravian Ave., Allentown, Pa. 18103

[21] Appl. No.: 09/166,996

[22] Filed: Oct. 5, 1998

[51] Int. Cl.[6] ..... B01D 46/02

[52] U.S. Cl. ..... 55/367; 55/369; 55/377; 55/379; 55/DIG. 2

[58] Field of Search ..... 55/367, 369, DIG. 2, 55/377, 379, 385.3; 493/186, 214

[56] References Cited

U.S. PATENT DOCUMENTS

| | | | |
|---|---|---|---|
| 1,801,193 | 4/1931 | Darst | 55/369 |
| 1,914,370 | 6/1933 | Hutchison, Jr. | 55/369 |
| 1,930,659 | 10/1933 | Purdy | 55/369 |
| 2,039,741 | 5/1936 | Richards | 55/367 |
| 2,171,754 | 9/1939 | Jeunesse | 55/369 |
| 2,241,601 | 5/1941 | Kessler | 55/367 |
| 3,203,551 | 8/1965 | Van Loan, Jr. | 55/369 |
| 3,724,186 | 4/1973 | Mattson | 55/369 |
| 4,311,493 | 1/1982 | Schaefer et al. | 55/369 |
| 5,009,633 | 4/1991 | Smaling | 493/214 |
| 5,090,975 | 2/1992 | Requejo et al. | 55/367 |
| 5,306,534 | 4/1994 | Bosses | 55/382 |
| 5,370,597 | 12/1994 | Genovese et al. | 493/186 |
| 5,509,853 | 4/1996 | Wells | 55/385.3 |

*Primary Examiner*—David A. Simmons
*Assistant Examiner*—Minh-Chau T. Pham
*Attorney, Agent, or Firm*—Porter, Wright, Morris & Arthur LLP

[57] ABSTRACT

A disposable reusable vacuum cleaner bag for a vacuum cleaner of the home appliance type is disclosed. The vacuum bag has an inlet for receiving materials from the vacuum cleaner, an apparatus for attaching the bag to the vacuum cleaner, and a resealable outlet for removing collected vacuumed materials from the bag whereby the bag is reusable in a next dirt collection/disposal cycle. The outlet may be sealed by a compression fit polymer fastener, a zipper, hook and loop fasteners, or any other suitable closure.

8 Claims, 5 Drawing Sheets

MULTIPLE USE DISPOSABLE VACUUM CLEANER BAG

BACKGROUND OF THE INVENTION

1. Field of Invention

This invention pertains to the art of methods and apparatus for collecting dirt in a vacuum cleaner of the home appliance type and disposing of the collected dirt, and more specifically to a reusable disposable bag for use with a home vacuum cleaner and a multiple use disposable vacuum cleaner bag.

2. Description of the Related Art

The typical home use vacuum cleaner bag is a permanently sealed paper bag that when filled with dirt is tossed out in the trash. Vacuum cleaner bags contain an inlet at the point where the vacuum cleaner bag is attached to the vacuum cleaner. When the vacuum cleaner bag becomes full, the vacuum cleaner bag is disposed of in the garbage. Additionally, if a small object such as jewelry, toy parts, etc., is accidentally vacuumed, the vacuum cleaner bag needs to be cut open to retrieve the object, regardless of the age or fill status of the vacuum cleaner bag.

The present invention is a new and improved vacuum cleaner bag which is simple in design, effective in use, and overcomes the foregoing difficulties and others while providing better and more advantageous overall results. The bag of the invention, from a cost standpoint, fits within the scope of a disposable product but is nevertheless capable of use and re-use through multiple dirt fill and dirt disposal cycles.

SUMMARY OF THE INVENTION

In accordance with the present invention, a new and improved home vacuum cleaner bag is provided which is reusable. According to one aspect of the present invention, a dirt collection bag for use with a vacuum cleaner is disclosed which includes an inlet for receiving vacuumed materials from the vacuum cleaner, a means for attaching the bag to the vacuum cleaner, and an outlet for removing the vacuumed materials from the bag. Another aspect of the present invention includes a method of vacuuming using a vacuum cleaner, creating a vacuum, directing the vacuum flow to a canister, and collecting dirt in a bag with a sealing means for opening and closing the bag. The steps include vacuuming an area, disengaging the vacuum apparatus, opening the sealing apparatus of the bag, emptying the bag, and closing the sealing apparatus of the bag.

One advantage of the present invention is that a single, reusable vacuum bag may be recycled and used a number of times. The present invention provides a reusable vacuum bag that, spreading the cost over multiple re-uses, is less expensive than a plurality of single use vacuum bags that would be used in the same number of fill cycles. Another advantage of the present invention is that a single reusable vacuum cleaner bag, according to the present invention, may replace approximately 30 single use vacuum bags, thereby also providing an environmental benefit by reducing paper volume in household trash. Yet another advantage of the present invention is that objects accidentally vacuumed and directed into the bag may be removed from the vacuum cleaner bag by opening the disposal seal and removing the object without having to destroy the vacuum cleaner bag. Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof. In the drawings.

DESCRIPTION OF THE PREFERRED EMBODIMENT

Figure 1:
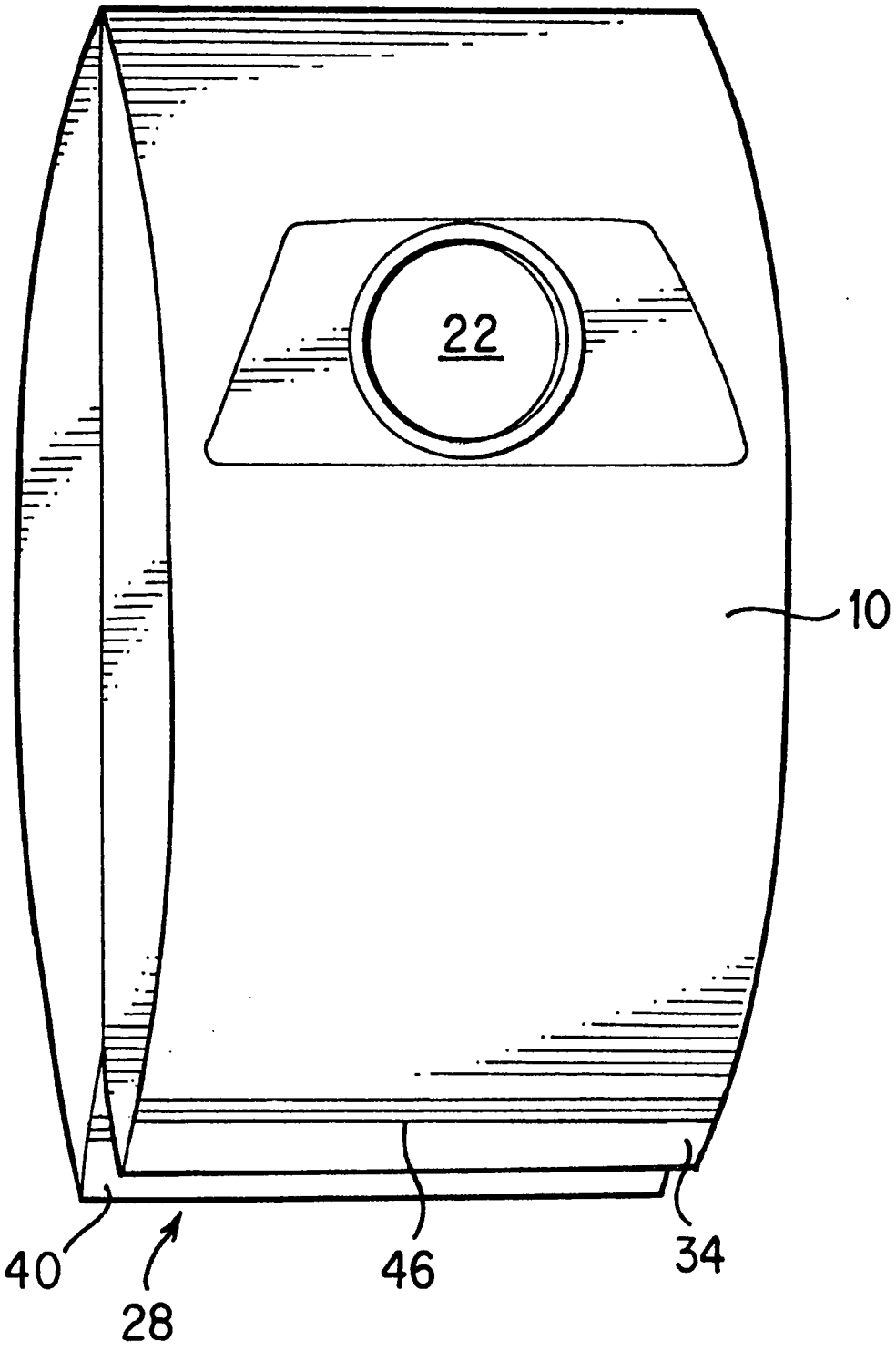
FIG. 1 shows a perspective view of the vacuum cleaner bag according to the present invention.
Figure 2:
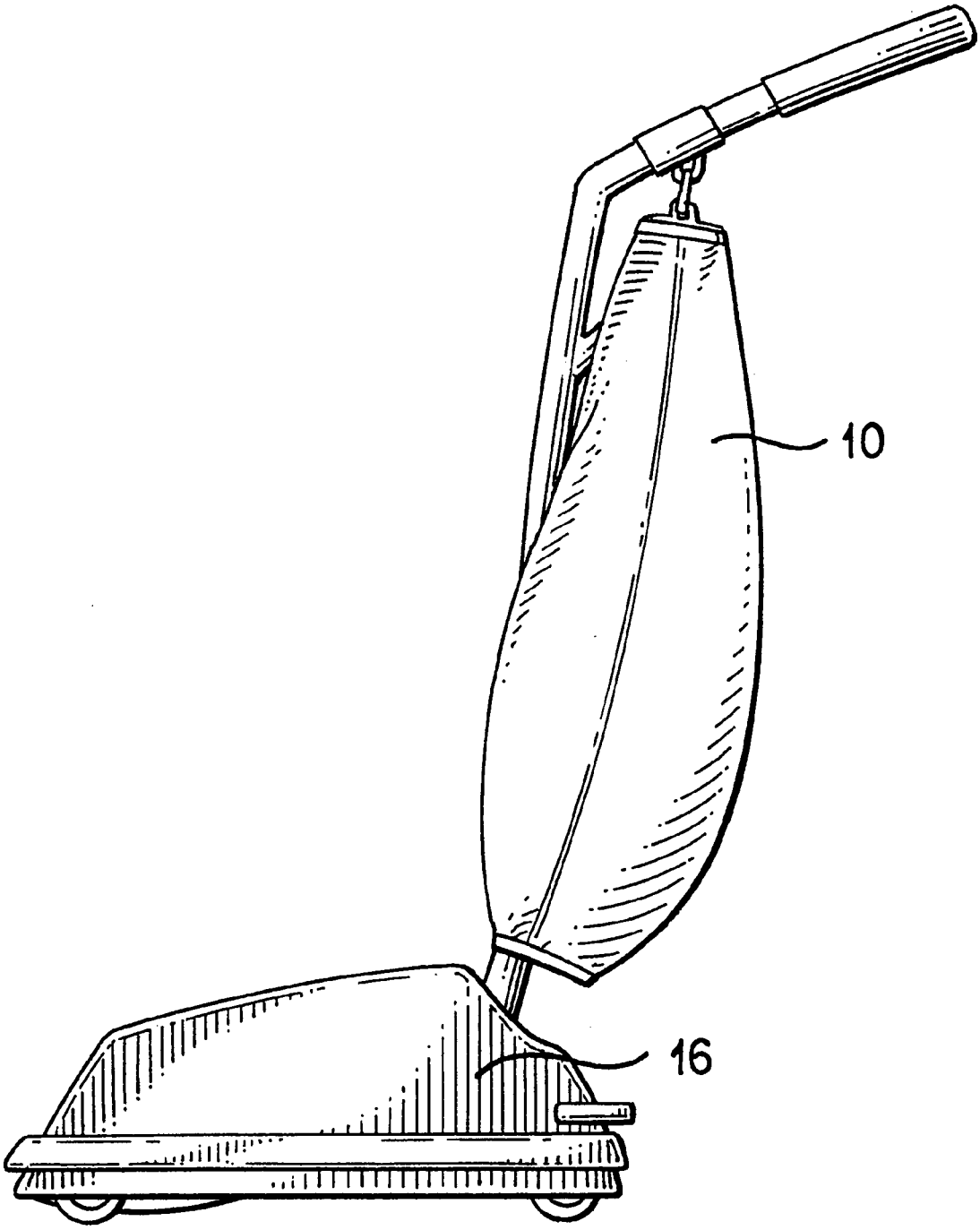
FIG. 2 shows a perspective view of a vacuum cleaner.

Referring now to the drawings which are for purposes of illustrating a preferred embodiment of the invention only and not for purposes of limiting the same, FIG. 1 shows a perspective view of a vacuum cleaner bag 10. The typical vacuum cleaner bag 10 is attached to the vacuum outlet of a vacuum cleaner 16, as shown in FIG. 2; however, the present invention may be used with any type of home vacuum cleaner and bags, such as uprights, canisters, portable vacuums and hand-held.

The vacuum cleaner bag 10 has a inlet 22 which is attached to the vacuum cleaner outlet 16. Pneumatic air flow, not a subject of the present application, provides a vacuum that sucks in dirt and directs the air flow and dirt from the vacuum cleaner inlet to outlet 16 where the air passes through the collection bag where dirt is collected in the bag. Dirt and other materials which are sucked into the vacuum cleaner outlet 16 are passed along through the vacuum cleaner outlet 16 and into the vacuum cleaner bag 10 through bag inlet 22. While different makes and models of vacuum cleaners have different outlet orifices which must be matched by the inlet 22 of the vacuum cleaner bag 10, the most common shape of the inlet 22 is circular. However, inlet 22 may be any other shape required to match the vacuum cleaner 16.

The vacuum cleaner bag of the invention 10 also has a resealable outlet opening 28. The outlet 28 has a first lip 34 and a cooperating second lip 40, which are sealed together to close the vacuum cleaner dirt collection bag 10 during operation of the vacuum cleaner 16. The cooperating lip seals may be opened to empty the contents of the vacuum cleaner bag 10 when the vacuum cleaner bag becomes full. In the preferred embodiment of the invention, when the vacuum cleaner is in operation the outlet 28 is sealed to collect vacuumed materials. Thereafter the outlet 28 may be unsealed to allow disposal of the materials, and resealed so as to make the vacuum cleaner bag 10 reusable. The first lip 34 and second lip 40 are sealed together by bringing the two lips 34, 40 into an engaging contact with one another. A suitable means for bringing the two lips, 34 and 40, together in the preferred embodiment a compression fit polymer zip fastener for engaging the two lips 34 and 40. In an embodiment this compression fit polymer zip fastener 46 is preferably of the type typically found on ZIPLOC® and HEFTY® zip fastener plastic bags that are common household items. This is an inexpensive zip fastening system that can be readily applied to a prefabricated conventional paper vacuum cleaner bag.

Figure 5:
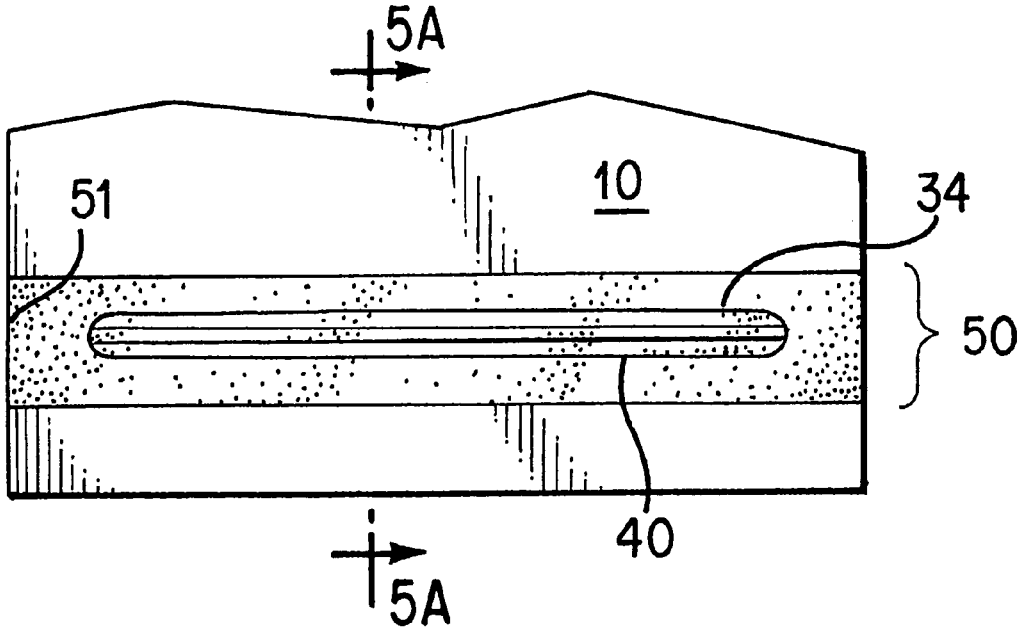
FIG. 5 shows a compression fit polymer "zip" seal extending along a linear closure of the bag.
Figure 5A:
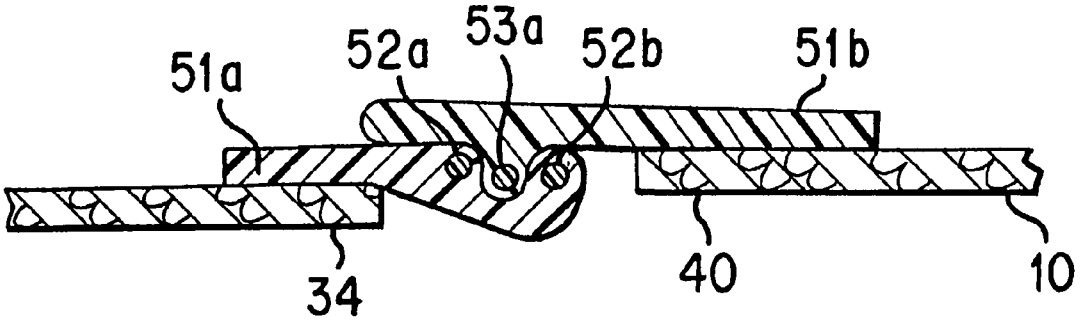
FIG. 5A is a cross-section of a zip seal taken along line 5A of FIG. 5.
Figure 5B:
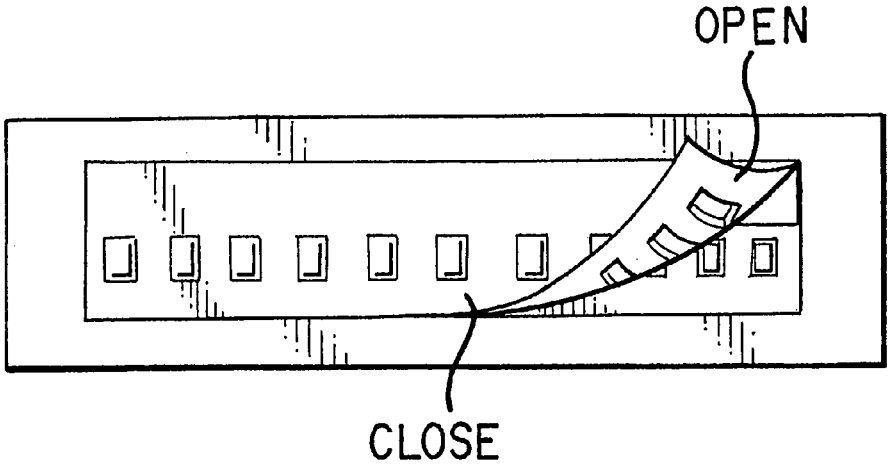
FIG. 5B shows an alternate zip seal mechanism in which the zip closure is transverse to the longitudinal closure of the bag seal.

Such fasteners as are found in household food storage bags are known as linear zip closures and are typically molded intrinsically into a sealable/unsealable polymer bag. For use with a paper vacuum bag, however, such a fastener with appropriate support and bonding sections must be bonded adjacent the lip openings of the bag such as with an adhesive, hot melt or other glue, or single or double sided tape. FIG. 5 shows such a linear zip sealing means 50 attached to the collection bag 10 at lips 34 and 40. The zip sealing means 50 is bonded to the bag in the shaded area shown in FIG. 5 with its resealable operating 51 superimposed over the bag lip opening. The zip seal typically includes a hard polymer insert tubing molded intrinsically in a softer polymer sheet material in which one shaped section is inserted into a corresponding shaped section to seal the closure. This representative configuration is shown in FIG. 5A representing a cross-section of the closure in which 51*a* and 51*b* represent the side edge portions of the closure bonded to the bag 10 adjacent lips 34 and 40. The portions 51*a* and 51*b* are formed of a soft polymer with intrinsic hard polymer strands 52*a* and 52*b* and 53*a* molded therein. While a "1 into 2" fastener is shown, a "2 into 3", "3 into 4" and like configurations are also possible. While a longitudinal fastener is shown extending parallel to the lips, certain fasteners are available that include the cooperating seals transverse to the line of the linear closure at the bag lips as shown in FIG. 5B with each section providing essentially the sealing relationship shown in FIG. 5A.

Figure 3:
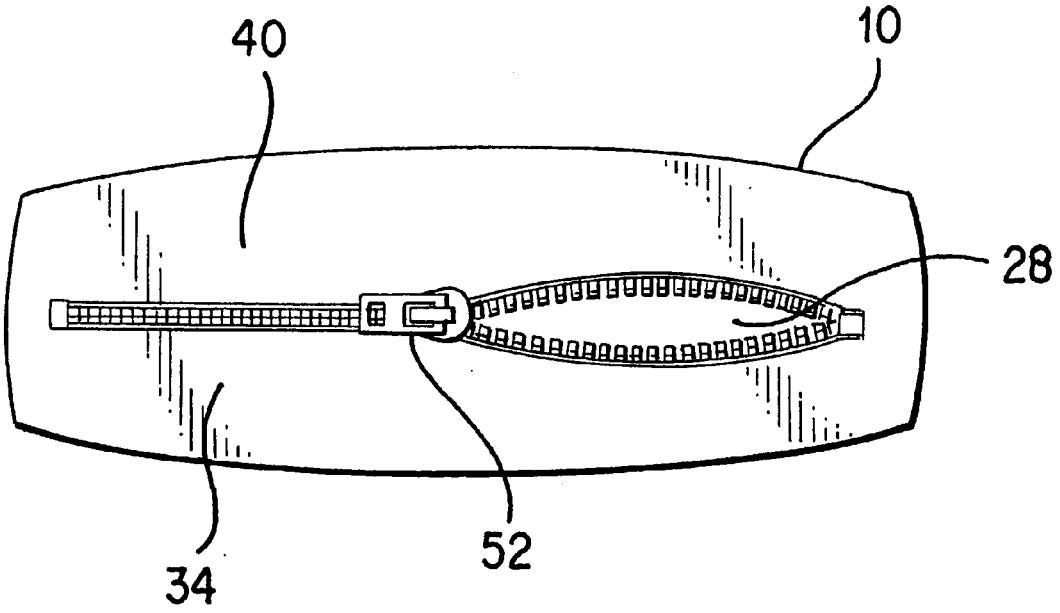
FIG. 3 shows one embodiment of the vacuum cleaner bag of the present invention.
Figure 4:
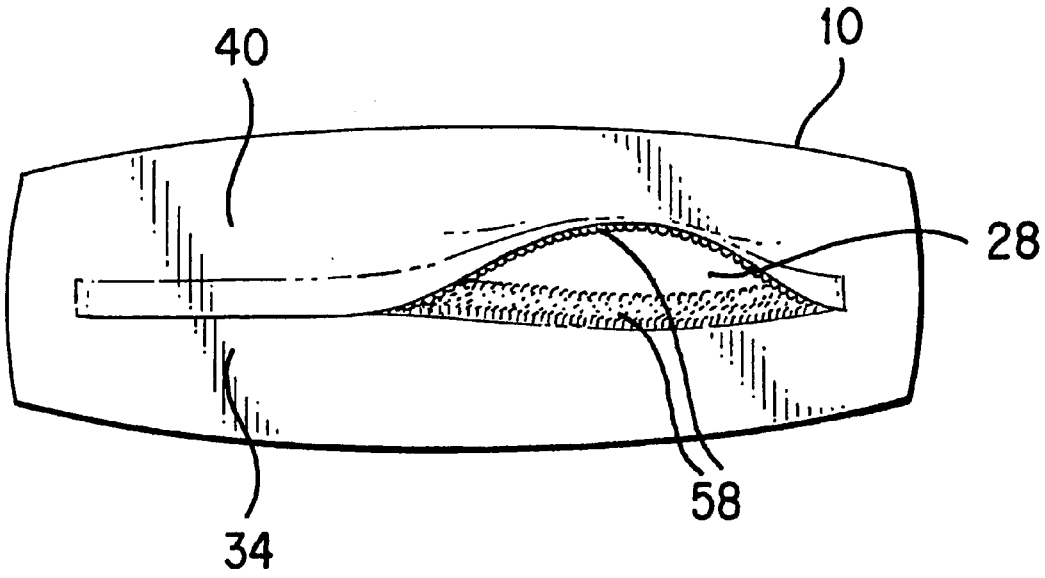
FIG. 4 shows another embodiment of the vacuum cleaner bag.

FIG. 3 shows an alternate embodiment of the present invention where the sealing apparatus for closing and sealing the vacuum cleaner bag 10 outlet 28 is a zipper 52, whereby the zipper 52 engages both the first lip 34 and second lip 40. FIG. 4 shows yet another alternate embodiment of the present invention where the sealing apparatus for sealing the first lip 34 and second lip 40 includes hook and loop fasteners 58, where the hooks are attached to the first lip 34 and the loops are connected to the second lip 40. Any other suitable method or apparatus for connecting the two lips 34,40 of the outlet 28 may also be used. The vacuum cleaner bag 10 with the resealable outlet 28 may be tailored to fit with any type or style of vacuum cleaner. Further, the resealable outlet 28 may be opened to empty dirt and other particles collected by the vacuum cleaner 16, or the outlet may be opened to retrieve an object which was accidentally captured by the vacuum cleaner 16 without destroying the vacuum cleaner bag 10.

Figure 6:
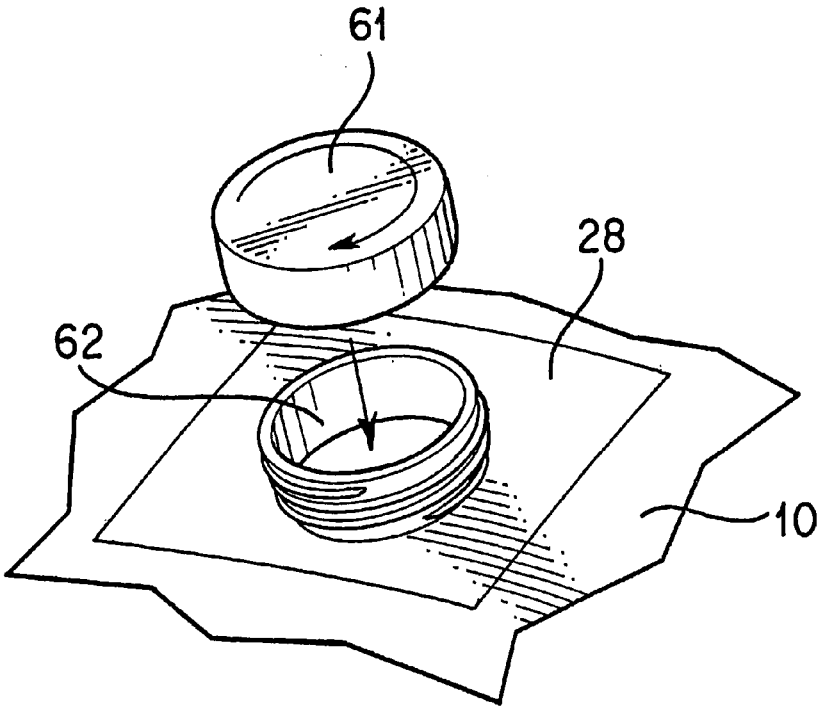
FIG. 6 shows an alternate screw cap closure mechanism.

While preferred embodiments of the invention describe outlet 28 as containing two lips 34 and 40 which are sealed together during use of the vacuum cleaner bag 10 and opened to empty the vacuum cleaner bag 10, any other suitable apparatus may also be employed with the present invention. For example, FIG. 6 shows an alternate embodiment of the present invention where the sealing apparatus for closing and sealing the vacuum cleaner bag 10 outlet 28 is a screw-on cap closure including screw cap 61 and base 62. The outlet 28 may also be fitted with a plug or similar apparatus to seal the vacuum cleaner bag 10 during operation of the vacuum cleaner 10, and to allow the vacuum cleaner bag 10 to be emptied by removal of the plug type apparatus.

The preferred embodiments have been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof. Having thus described the invention,

We claim:

1. In a paper disposable dirt collection bag for use with an associated home appliance vacuum cleaner, the vacuum cleaner including vacuum means for collecting dirt and associated material, the vacuum means for collecting dirt operatively interconnected to a dirt collection bag, where during operation of the vacuum cleaner, the dirt collected is, by pneumatic force flow, directed into the bag and temporarily stored therein until the bag is filled and the collected dirt is thereafter disposed of, the combination comprising:

a disposable bag formed from a paper material;

an inlet in the bag for receiving vacuumed materials from said associated vacuum cleaner;

means for attaching said bag to said associated vacuum cleaner such that the pneumatic force of the vacuum directs the collected dirt to the bag;

a first outlet in the bag to relieve pneumatic pressure therein and to maintain the pneumatic force flow of the din from the vacuum means for collecting dirt into the bag; and a second outlet in the bag spaced apart from the inlet thereof, the second outlet comprising a polymer fastener mechanism formed intrinsically from a polymer material bonded to the paper bag, said fastener being alternately temporarily sealable when the vacuum cleaner is in operation ald the bag is receiving the dirt for collection into the bag, and temporarily unsealable when the vacuum bag is not in operation and dirt collected in the bag as a result of the vacuum cleaner operation is disposed of from the bag, whereby the bag is thereafter resealed for use in the vacuum cleaner in a continuing limited number of approximately up to 30 alternating cycles of reuse for receiving dirt in a sealed mode when attached to the vacuum cleaner and allowing the collected dirt to be disposed of from the bag when the bag is unsealed.

2. The bag of claim 1, wherein said polymer fastener comprises a compression fit zip fastener.

3. The bag of claim 1, wherein said polymer fastener comprises hook and loop fasteners.

4. The bag of claim 1, wherein said polymer fastener comprises a screw-on cap closure.

5. The bag of claim 2 in which the compression fit polymer zip fastener includes on a first lip a linear polymer insert segment extending from the surface thereof along the length of the outlet closure means and the second lip includes a co-operating receiving groove formed from a complementary polymer material whereby frictional compression between the polymer insert section adjacent one lip and the receiving groove adjacent the second lip maintains the fastener in closed position and the application of a decompressive force between the insert and groove allows the fastener to be opened for the disposal of material collected in the bag.

6. The bag of claim 5 in which the polymer zip fastener extends longitudinally essentially parallel to the lips of the bag opening.

7. The bag of claim 6 in which the polymer fastener is a zip closure with an insert section and cooperating groove section extending parallel to the lip opening.

8. The bag of claim 7 in which the polymer fastener is a zip closure extending parallel to the lip opening, in which insert and groove elements are included transverse to the lip opening.

* * * * *